US011490769B1

(12) United States Patent
Bindler

(10) Patent No.: US 11,490,769 B1
(45) Date of Patent: Nov. 8, 2022

(54) BAR SOAP GRINDING DISPENSER

(71) Applicant: Yakov Bindler, Hastings On Hudson, NY (US)

(72) Inventor: Yakov Bindler, Hastings On Hudson, NY (US)

( * ) Notice: Subject to any disclaimer, the term of this patent is extended or adjusted under 35 U.S.C. 154(b) by 115 days.

(21) Appl. No.: 16/654,500

(22) Filed: Oct. 16, 2019

Related U.S. Application Data

(63) Continuation-in-part of application No. 15/426,905, filed on Feb. 7, 2017, now Pat. No. 10,524,620.

(60) Provisional application No. 62/746,171, filed on Oct. 16, 2018, provisional application No. 62/344,188, filed on Jun. 1, 2016.

(51) Int. Cl.
*A47K 5/09* (2006.01)

(52) U.S. Cl.
CPC ..... *A47K 5/09* (2013.01)

(58) Field of Classification Search
CPC ..... A47K 5/09; A47K 5/1217; A47K 5/1202; A47K 5/1211; Y10S 241/17; Y10S 241/602; B02C 19/20; B02C 18/144; C11D 13/22; A47J 43/255
USPC ..... 241/59, 602, 93, 169.1, 280
See application file for complete search history.

(56) References Cited

U.S. PATENT DOCUMENTS 445,769 A * 2/1891 Chamberlin ..... A47J 43/255 241/93
711,264 A * 10/1902 Rothschild ..... A47J 43/255 241/273.3
867,976 A * 10/1907 Irenius ..... D21B 1/063 241/282
1,357,925 A * 11/1920 Asel ..... A47K 5/09 241/273.2
2,011,128 A * 8/1935 Voorhis ..... A47K 5/09 241/101.3
2,029,701 A * 2/1936 Burditt ..... A47K 5/09 241/277
2,191,003 A * 2/1940 Voorhis ..... A47K 5/09 241/101.3
2,279,602 A * 4/1942 Voorhis ..... A47K 5/09 241/30
2,441,034 A * 5/1948 Pumphrey ..... A47K 5/09 241/280
2,489,081 A * 11/1949 Crichton ..... A47K 5/09 241/273.3
2,893,960 A * 7/1959 McNally ..... A47K 5/09 510/149
4,386,740 A * 6/1983 Van Deursen ..... A47J 43/255 241/285.2

(Continued)

*Primary Examiner* — Charles P. Cheyney
(74) *Attorney, Agent, or Firm* — Christopher J. Scott

(57) ABSTRACT

A congealed product grinding and dispensing machine is disclosed. The machine has a housing with an aperture through a wall for dispensing ground soap chips. A product chute located within the housing feeds bar soap toward a rotary cutting tool which is driven by an electric motor within the housing. An actuator in circuit with the motor and a control circuit energizes the motor for a preset time period when the actuator is actuated. Another embodiment disclosed includes an inclined product chute which simplifies soap bar loading. Additional elements of the invention involve including a proximity sensor as the actuator and incorporating a programmable display into the machine housing, the display being in circuit with the actuator.

18 Claims, 17 Drawing Sheets

(56) References Cited

U.S. PATENT DOCUMENTS

| | | | | | |
|---|---|---|---|---|---|
| 5,495,795 | A * | 3/1996 | Harrison | A47J 19/027 | 241/37.5 |
| 5,836,482 | A * | 11/1998 | Ophardt | A47K 5/1202 | 222/325 |
| 6,464,156 | B1 * | 10/2002 | Wexell | A22C 17/06 | 241/169.1 |
| 8,245,877 | B2 * | 8/2012 | Ophardt | A47K 5/1217 | 222/63 |
| 8,939,070 | B2 * | 1/2015 | Cheung | A23N 1/02 | 99/513 |
| 8,939,390 | B2 * | 1/2015 | Machovina | A47J 43/0722 | 241/260.1 |
| 9,282,853 | B2 * | 3/2016 | Machovina | A47J 43/085 | |
| 10,524,620 | B1 * | 1/2020 | Bindler | B02C 25/00 | |
| 2006/0124662 | A1 * | 6/2006 | Reynolds | B41J 2/17546 | 222/23 |
| 2015/0313420 | A1 * | 11/2015 | Tramontina | A47K 5/1217 | 222/63 |
| 2016/0052007 | A1 * | 2/2016 | Fuller | B01F 33/841 | 222/638 |

* cited by examiner

BAR SOAP GRINDING DISPENSER

CROSS-REFERENCE TO RELATED APPLICATION

This application claims the benefit of U.S. Provisional Patent Application No. 62/746,171 filed Oct. 16, 2018 which application is hereby incorporated by reference.

This application is a continuation-in-part of U.S. patent application Ser. No. 15/426,905 filed Feb. 7, 2017 which application is hereby incorporated by reference.

BACKGROUND

Field of the Invention

This invention relates generally to the field of soap dispensers, and more particularly to automated dispensers of bar soap pieces for individual, one-time use.

Bars of soap have been used for many years as a convenient way to clean one's hands by rubbing the bar between wet hands and letting the soap mingle with water to create a soapy lather that can perform cleaning actions. Bar soap is often used in this way in household and other similar settings where access to the bar is limited to a relatively small number of familiar people. The use of bar soap often becomes less appealing in settings where it is available to larger numbers of people due to worry of cross contamination or the bar being carried off, for example. These concerns can hamper use of specialty or luxury bar soaps (which have become increasingly popular in recent years) in settings where access is somewhat limited but still public in nature, such as in bathrooms of upscale restaurants, for example.

One way to overcome these concerns is to restrict access to the bar itself and allow removal of chips from the bar which then can be used for cleaning purposes. Use of bar soap in this manner allows many people to use the same bar in a public setting without worry of cross contamination or loss. Therefore, it would be advantageous for those wishing to expand markets for specialty bar soaps to have an automated device which easily and conveniently provides chips from bar soap without having to come into direct physical contact with the bars themselves. This would allow use of bar soap in settings where liquid hand soap dispensers are currently used.

Although others have patented ways of cutting thin pieces of soap to be used for cleaning purposes, there still remains deficiencies in the prior art. One shortcoming is that soap cutting devices of the prior art use slicing actions, rather than a grinding or grating action, to cut the soap which results in larger pieces being produced. A grinding action can produce finer soap chips which make them easier and faster to dissolve when exposed to water.

Another shortcoming is that prior designs do not provide fully automated systems which are configured to conveniently drop a portion of soap chips into a person's hands for easy use in washing one's hands.

Finally, previous designs do not allow users to easily see when the soap needs to be replaced. It would additionally be advantageous to display the bar of soap being ground so that people who enjoy the experience of using the soap chips can take note of the soap brand and be able to perhaps purchase bars of that brand for their own private use.

A primary objective of this invention is to provide an automated device for grinding chips of soap from a bar and dispensing them into a person's hand for use in cleaning.

SUMMARY OF THE INVENTION

A congealed product grinding and dispensing machine is disclosed. The machine has a housing with an aperture through a wall for dispensing ground soap chips. A product chute located within the housing feeds bar soap toward a rotary cutting tool which is driven by an electric motor within the housing. An actuator in circuit with the motor and a control circuit energizes the motor for a preset time period when the actuator is actuated. Another embodiment disclosed includes an inclined product chute which simplifies soap bar loading. Additional elements of the invention involve including a proximity sensor as the actuator and incorporating a programmable display into the machine housing, the display being in circuit with the actuator.

Other objects and advantages of the invention will become apparent from the following descriptions, taken in connection with the accompanying drawings, wherein, by way of illustration and example, a preferred embodiment of the invention is disclosed.

BRIEF DESCRIPTION OF THE DRAWINGS

The features of the invention will now be described with reference to the drawings of a preferred embodiment, which are intended to illustrate and not limit the invention.

DETAILED DESCRIPTION OF A PREFERRED EMBODIMENT

A detailed description of a preferred embodiment is provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

FIGS. 1-8 show a preferred embodiment of a soap grinding dispenser according to the present invention. For descriptive purposes, the grinding dispenser may be broken down into four major parts as shown in FIG. 9: bottom enclosure assembly 1, top enclosure assembly 2, optional stand 3 and internal mechanical assembly 4.

Figure 10:
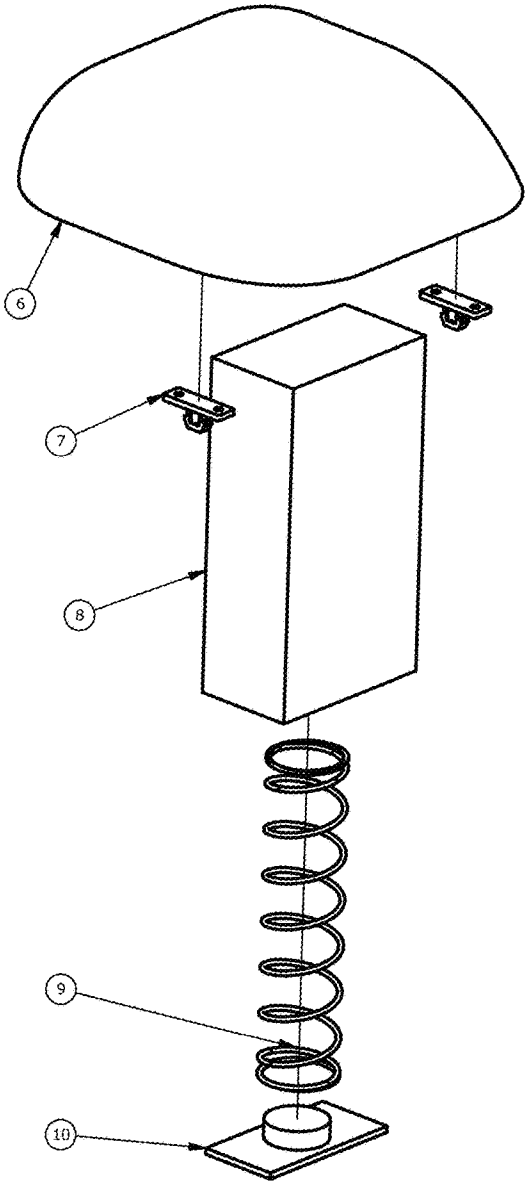
FIG. 10 is an exploded view of the grinding dispenser's top enclosure assembly.
Figure 11:
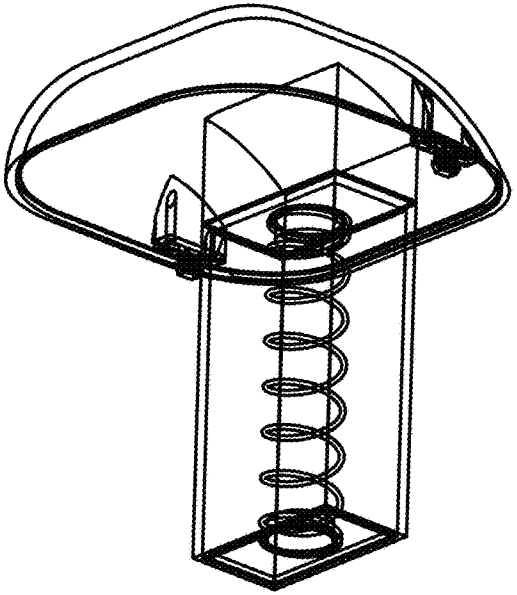
FIG. 11 is a transparent illustration of the grinding dispenser's top enclosure assembly.
Figure 13:
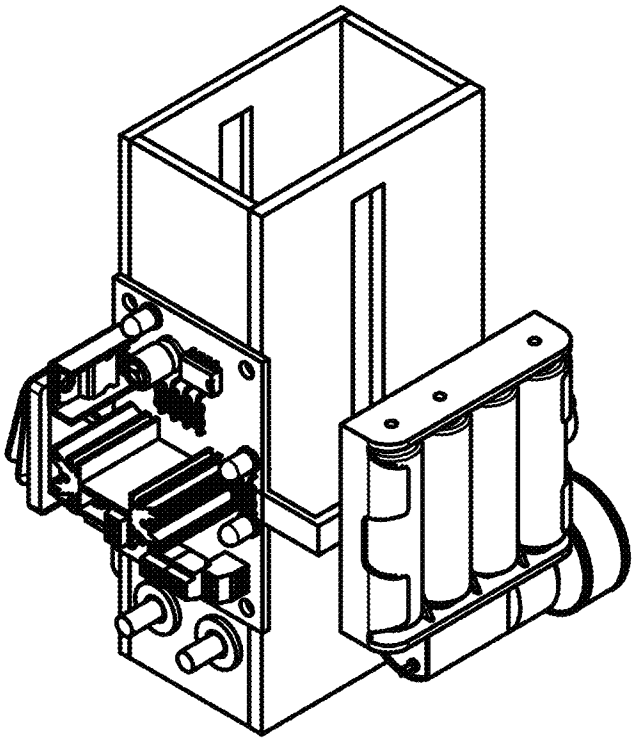
FIGS. 12 and 13 are front and rear perspective views of the grinding dispenser's internal mechanical assembly.
Figure 12:
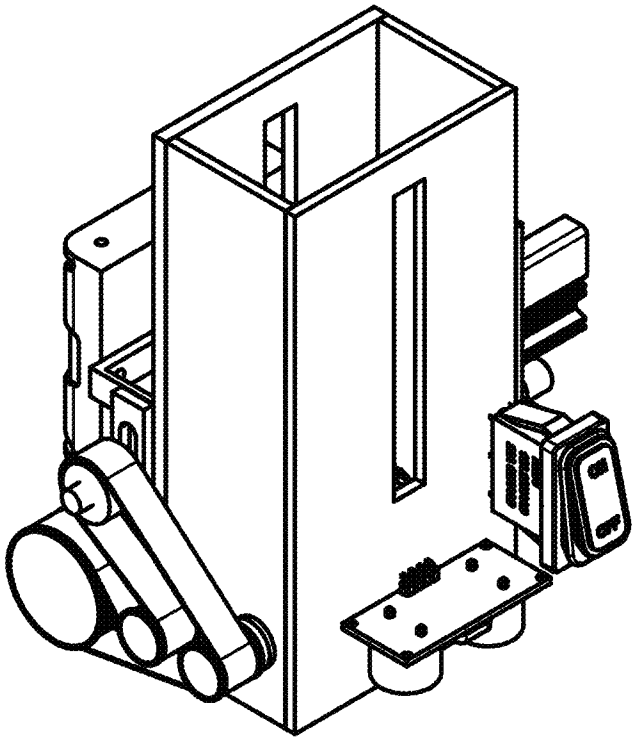
Figure 16:
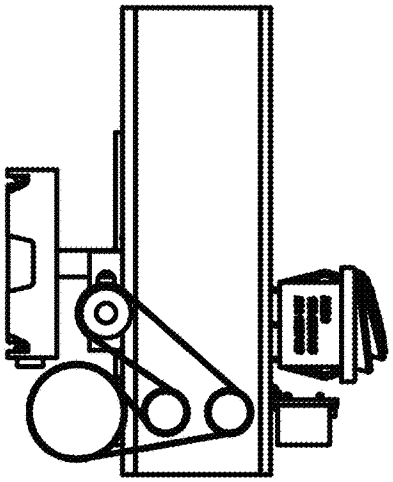
FIGS. 14-16 are left side, front, and right side elevational views of the grinding dispenser's internal mechanical assembly.
Figure 15:
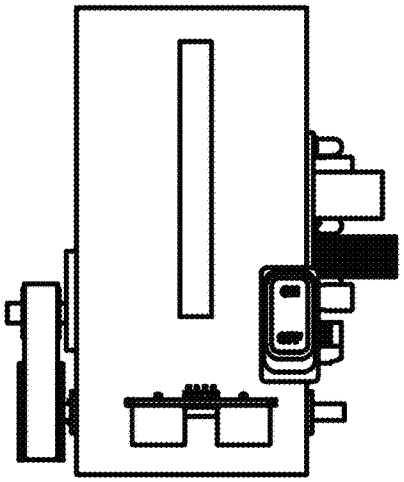
Figure 14:
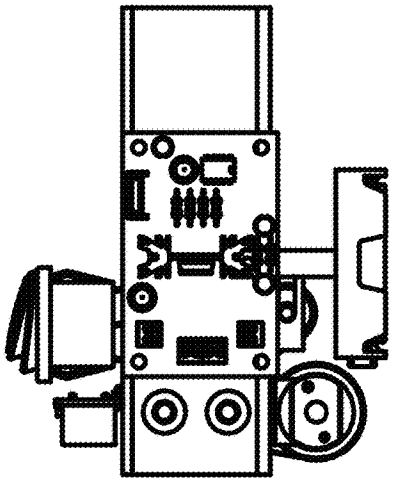
Figure 17:
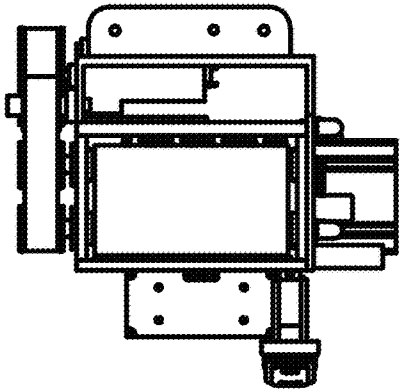
FIG. 17 is a top plan view of the grinding dispenser's internal mechanical assembly.
Figure 20:
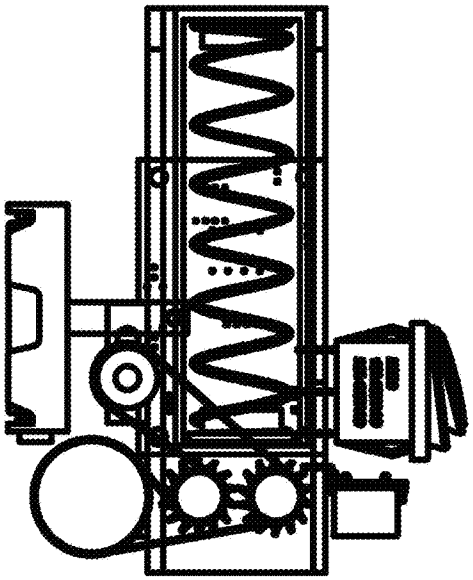
FIGS. 18-20 are the elevational view of FIGS. 14-16 in partial cross section.
Figure 19:
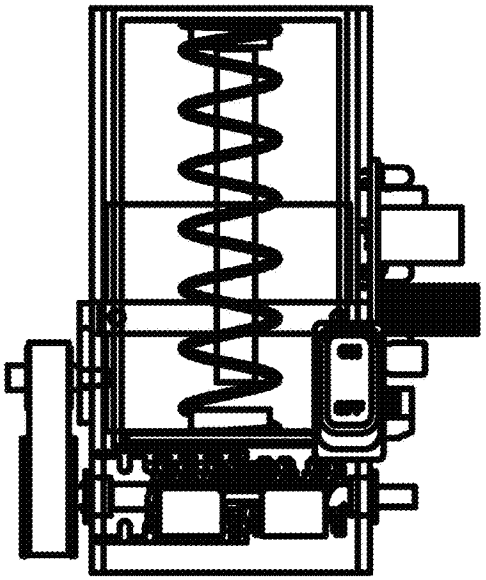
Figure 18:
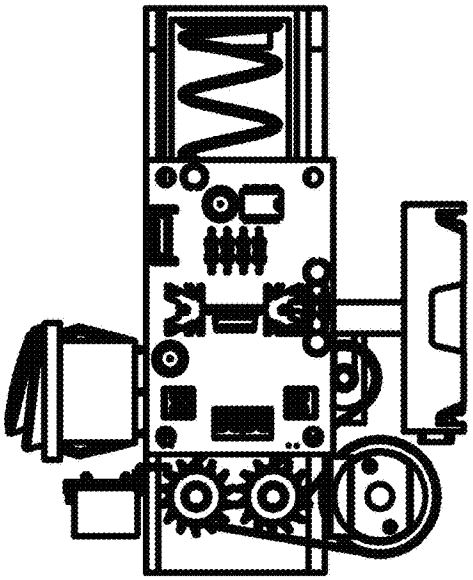
Figure 21:
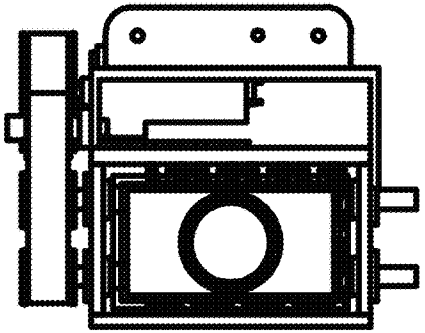
FIG. 21 is the top plan view of FIG. 17 with the internal soap enclosure removed.

To load a new bar of soap, top enclosure assembly 2 is removed from the grinding dispenser by pushing down on it to release quick release mechanisms 7, shown in exploded view FIG. 10. FIG. 10 shows top enclosure assembly 2 generally comprises top cap 6, quick release locks 7, internal soap enclosure 8, spring 9 and push feeder plate 10. The function of internal soap enclosure 8 is to house and direct spring 9 and push feeder plate 10.

As a new bar of soap 5 (FIG. 9) is inserted in the soap bar directional enclosure product chute 15 (FIG. 23), soap bar 5 slides within enclosure 15 in a piston fashion and rests on top of rotary cutting tools 17.

Figure 2:
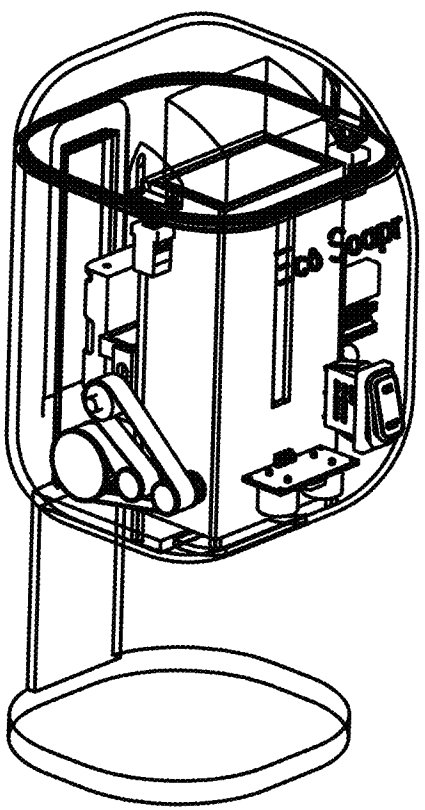
FIG. 2 shows the grinding dispenser of FIG. 1, transparently illustrated to show its inner components.
Figure 1:
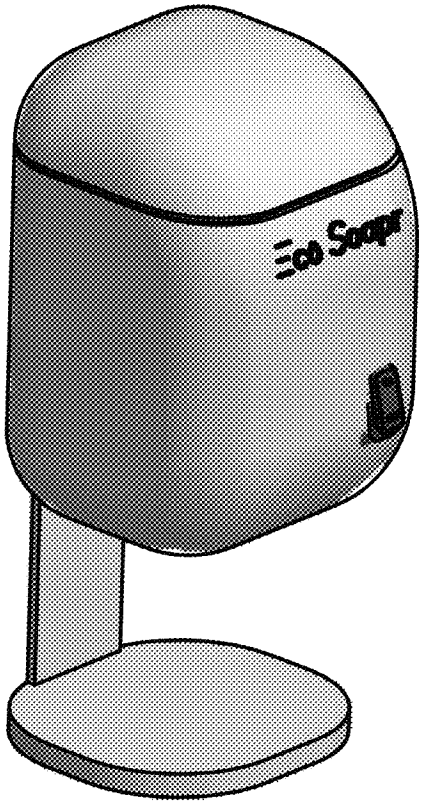
FIG. 1 shows a preferred embodiment of a bar soap grinding dispenser according to the invention.
Figure 4:
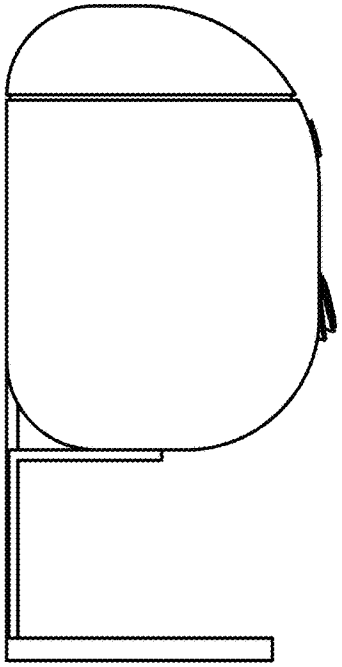
FIGS. 3 and 4 are front and side elevational views of the grinding dispenser of FIG. 1.
Figure 3:
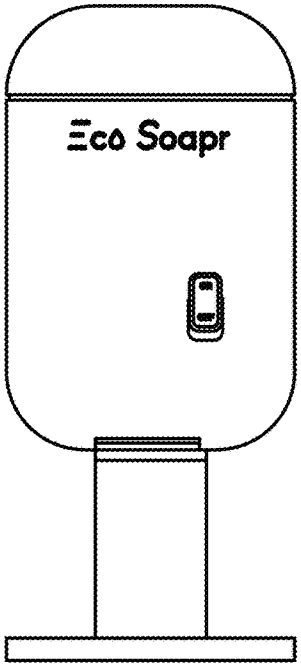
Figure 5:
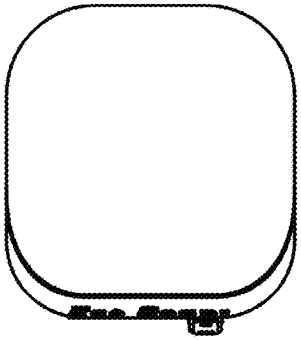
FIG. 5 is a top plan view of the grinding dispenser of FIG. 1.
Figure 7:
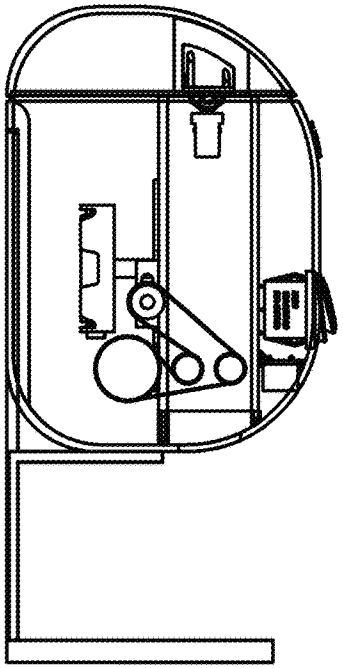
FIGS. 6-7 are the elevational view of FIGS. 3-4 with the grinding dispenser's enclosure transparently illustrated.
Figure 6:
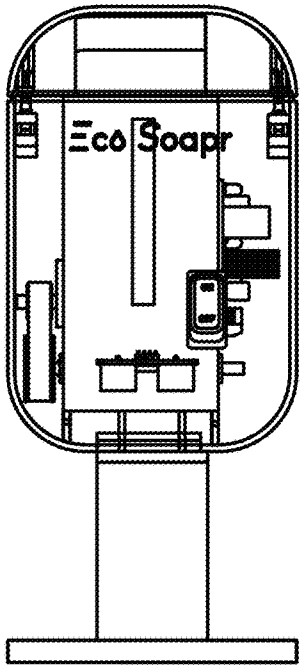
Figure 8:
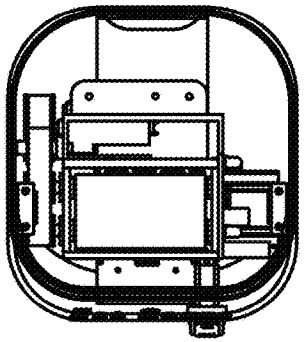
FIG. 8 is the top plan view of FIG. 5 with the grinding dispenser's enclosure transparently illustrated.
Figure 9:
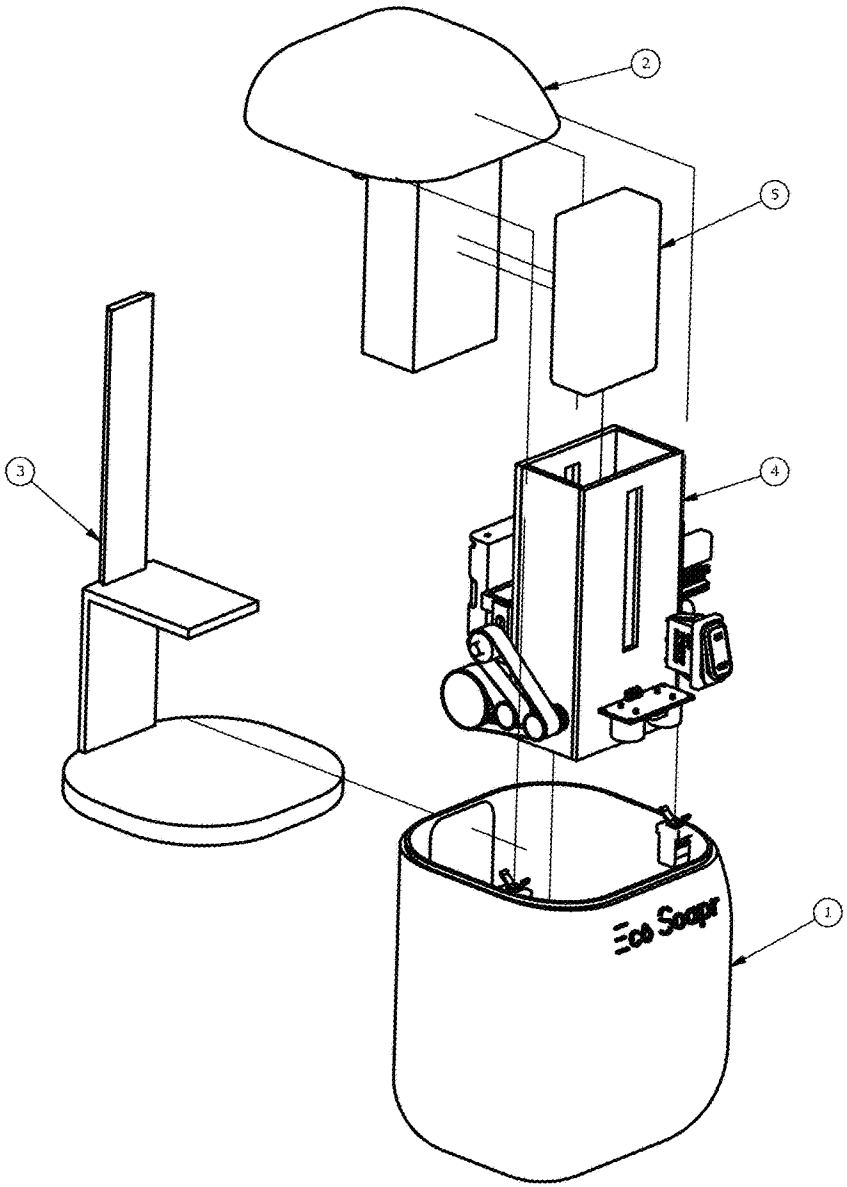
FIG. 9 is an exploded view of the grinding dispenser of FIG. 1.
Figure 23:
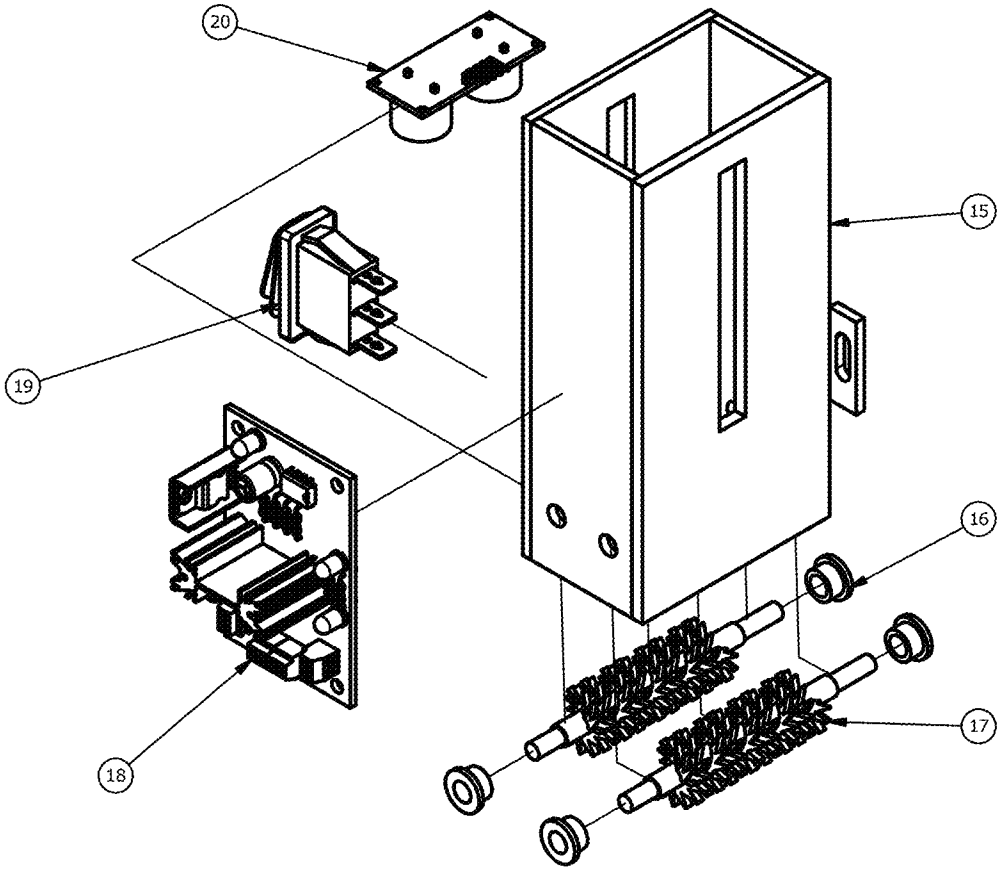

To ready the grinder dispenser for operation, internal soap enclosure 8 of top enclosure assembly 2 is inserted into directional enclosure product chute 15, as perhaps can best be appreciated when viewing FIGS. 9 and 10 in conjunction with FIG. 23. When top enclosure assembly 2 is pressed down, the walls of internal soap enclosure 8 slidably move between soap bar 5 and directional enclosure 15, while push feeder plate 10 presses against bar soap 5 and cause spring 9 to compress. After quick release locks 7 are locked, the grinder dispenser is ready for operation: the spring will apply pressure to the bar of soap and press it toward rotary cutters 17.

Figure 22:
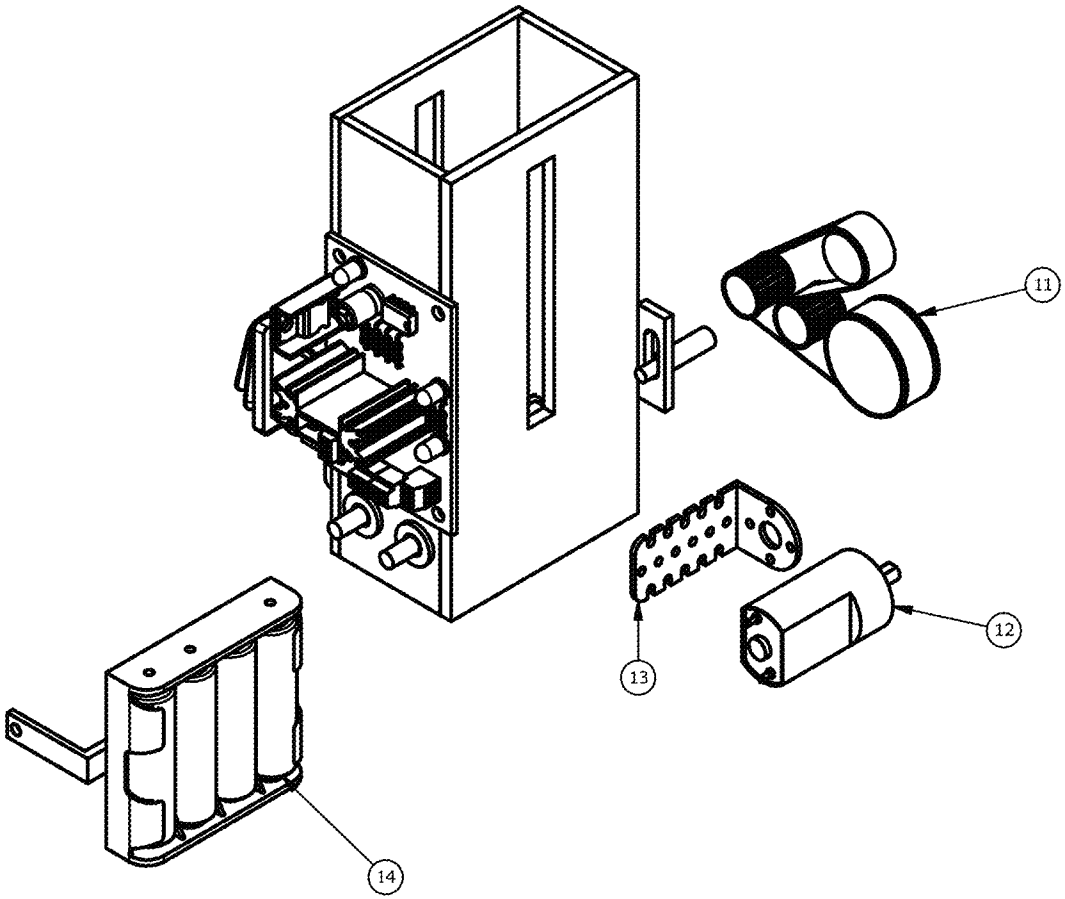
FIGS. 22 and 23 are exploded views of the grinding dispenser's internal mechanical assembly.

When switch 19 (FIG. 23) is placed in the "on" position, printed circuit board 18 will enable proximity sensor 20 to trigger motor 12 (FIG. 22). Motor 12 is powered by battery-containing pack 14 and connected to directional enclosure product chute 15 by motor bracket 13. Batteries used to power the grinding dispenser may be regular or rechargeable with charging to be done either inside the housing using the adapter or outside the unit in a separate battery recharging device. Once motor 12 is operational, it will transmit the rotational motion to rotary cutters 17 (FIG. 23) through pulley belt type system 11 (FIG. 22) causing rotary cutters 17 to start rotating. Bushings 16 (FIG. 23) will insure smooth, low friction rotation.

Rotary grinding cutters 17 are designed in such a way that there is plenty of space for soap chips (flakes) to fall down between the teeth of rotary cutters 17.

A person wishing to dispense soap chips (flakes) will hold his/her hand under housing 1, which triggers proximity sensor 20, thereby activating motor 12 that rotates rotary cutters 17 through pulley belt system 11.

Electric motors used in grinding dispensers of the invention are, generally speaking, continuous duty, low-speed, high-torque motors of relatively small size capable of fitting within bottom enclosure assembly 1. One preferable brushed DC motor which may be used is a Pololu 250:1 Metal Gearmotor 20Dx46L mm 6V; 60 RPM and 170 mA with no load; 170 oz-in (12 kg-cm) and 2.9A at stall; gearbox torque limit 70 oz-in (5 kg-cm). See https://www.pololu.com/product3458.

One example of an acceptable battery pack (14) is a 4-AA Enclosed Battery Holder with Switch. See https://www.pololu.com/product1159.

Different types of transmission systems may be used in grinding dispensers of the invention. The preferable pulley-belt system 11 shown in FIG. 22 used during prototyping activities associated with development of the invention were sourced from Stock Drive Products/Sterling Instruments. See http://shop.sdp-si.com/catalog. Pulley-belt system 11 generally comprises a drive pulley (A6A53M036DF0606), two driven pulleys (A6A53M016DF0606), an idler pulley (SS99GGFM050605), and a double-sided tooth belt (A6R53MD124060). It should be understood the disclosed specificity of particular parts used to make pulley-belt system 11 as shown has been made to enable one skilled in the art to build a grinding dispenser according to the invention and in no way is meant as a limitation on the patentable scope of the invention.

Different types of proximity sensors (20) and sensor arrangements may be used to accomplish actuation of printed circuit board 18. For example, proximity sensor 20 may be an infrared proximity sensor in a retro-reflective arrangement where the sensor's emission is reflected off the base of stand 3 (FIG. 9), or, alternatively, it may be arranged as a diffuse sensing field in instances where stand 3 is not used.

Figure 24A:
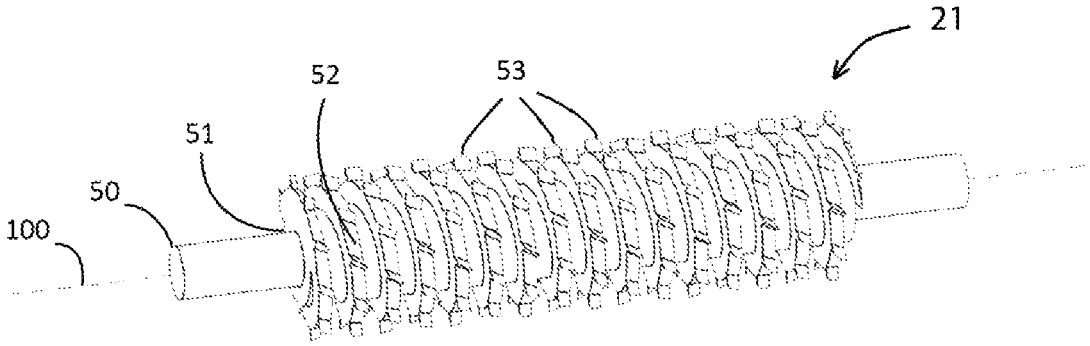
FIGS. 24A, 24B and 24C show three different variations of the grinder rotor.
Figure 24B:
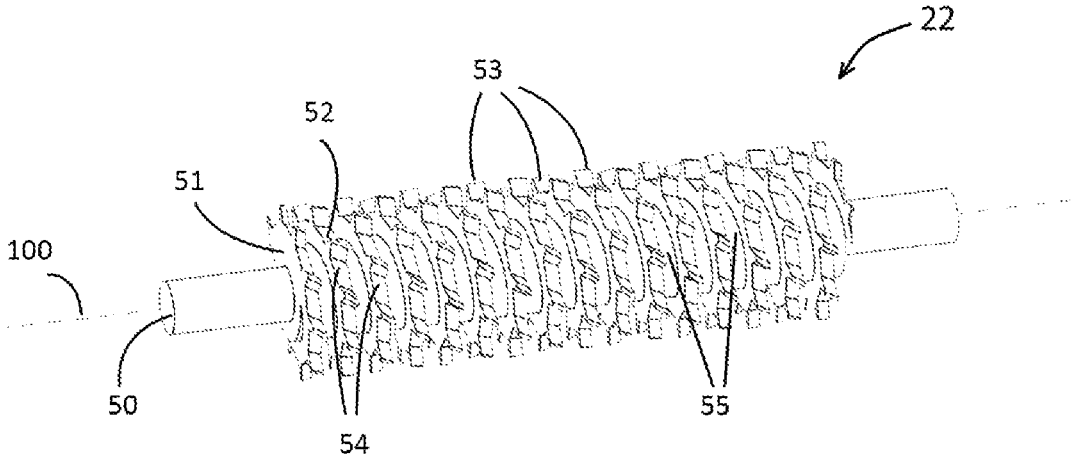
Figure 24C:
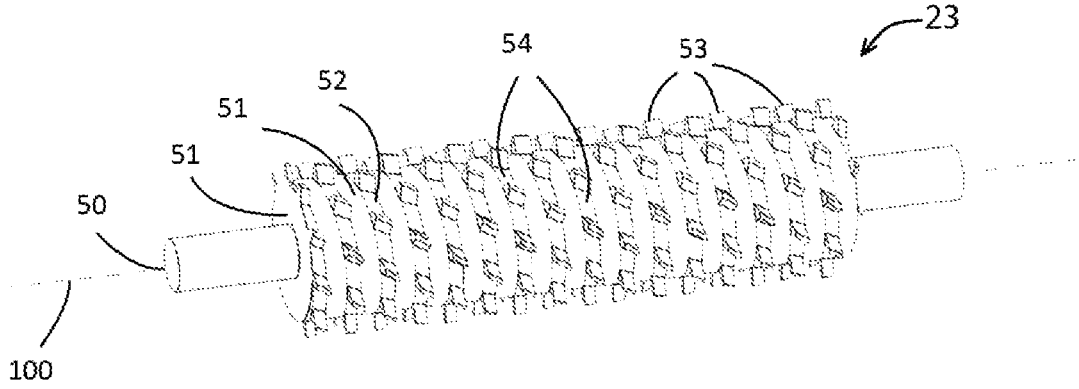
Figure 25:
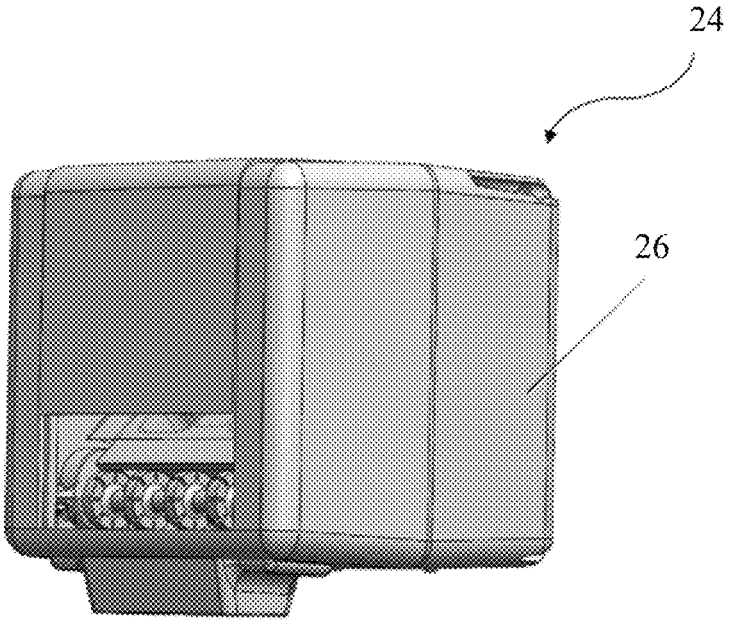
FIG. 25 shows another preferred embodiment of a bar soap grinding dispenser mechanism according to the invention.
Figure 26:
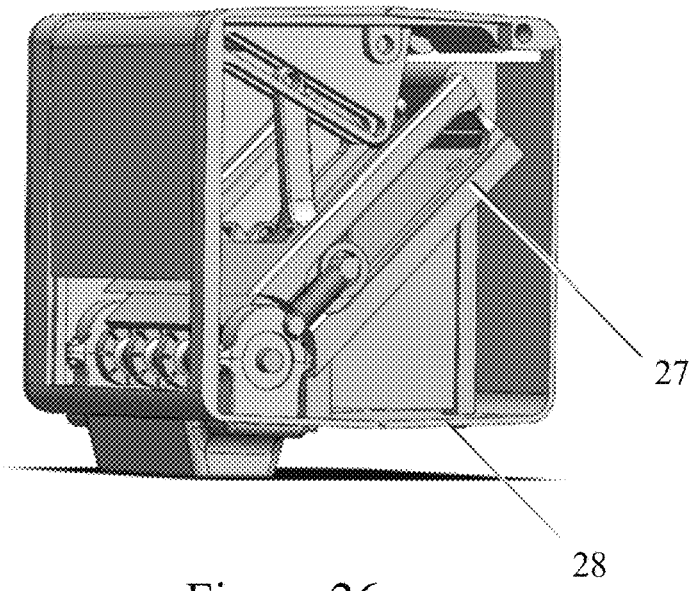
FIG. 26 shows the mechanism of FIG. 25 with a sidewall removed to show its internal components.

Rotary cutters 17 in FIG. 23 are designed as two rotatable shafts 3½ inches long with a central section about 2 inches wide, configured with 8 rows of teeth. The shafts shown are ¼ inch in diameter, and the outer diameter of the teeth is approximately/inch. This configuration of rotary cutters 17 was tested during prototyping activities associated with development of the invention and was found to provide satisfactory performance for its intended purposes. It should be understood that other configurations of rotary cutters are considered as falling within the patentable scope of the invention. For instance, the number of spacing of rows of teeth may be varied from the preferred embodiment disclosed. FIGS. 24A-24C show three variations 21, 22, and 23 of rotary cutters which may be used in the invention.

Comparatively referencing FIGS. 24A-24C, the reader will there see several alternative rotary cutters or rotatable grinder shafts 21, 22, and 23 each of which preferably comprise an inner shaft portion as at 50, an outer shaft portion as at 51, a cutting teeth portion as at 52, and a grinder shaft axis of rotation as at 100. The inner shaft portion 50 has a first shaft diameter and the outer shaft portion 51 has a second shaft diameter. The second shaft diameter is greater than the first shaft diameter. The cutting teeth portion 52 preferably comprises a plurality of circumferentially spaced cutting teeth as at 53, which teeth are preferably obliquely angled relative to the grinder shaft axis of rotation 100.

The cutting teeth portion 52 preferably also comprises a radially inner basal portion as at 54. The plurality of cutting teeth 53 extend radially outwardly from the radially inner basal portion 54. Referencing FIG. 24C, the reader will there see that the radially inner basal portion 54 preferably comprises a third shaft diameter, which third shaft diameter is equal to the second shaft diameter such that radially inner basal portion 54 and the outer shaft portion 51 are substantially flush with one another.

Alternatively referencing FIGS. 24A and 24B, the reader will there see the radially inner basal portion 54 comprises a third shaft diameter, which third shaft diameter is greater than the second shaft diameter of the outer shaft portion 51. The difference between the third shaft diameter and the second shaft diameter in these embodiments effectively forms chip-directing channels as at 55. The chip-directing channels 55 direct movement of chips cut from the congealed product intermediate substantially parallel radially inner basal portion(s) 55.

Figure 31:
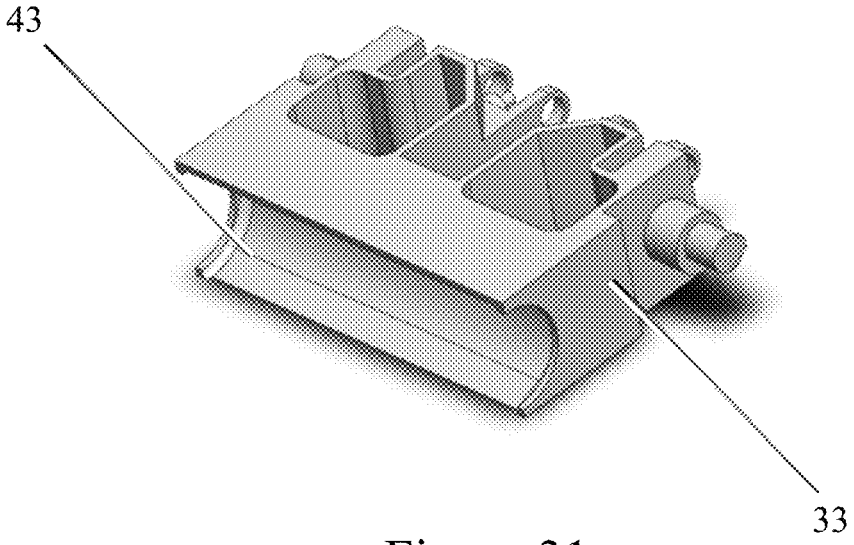
FIG. 31 is a perspective view of a pusher plate used in the mechanism of FIG. 25.
Figure 32:
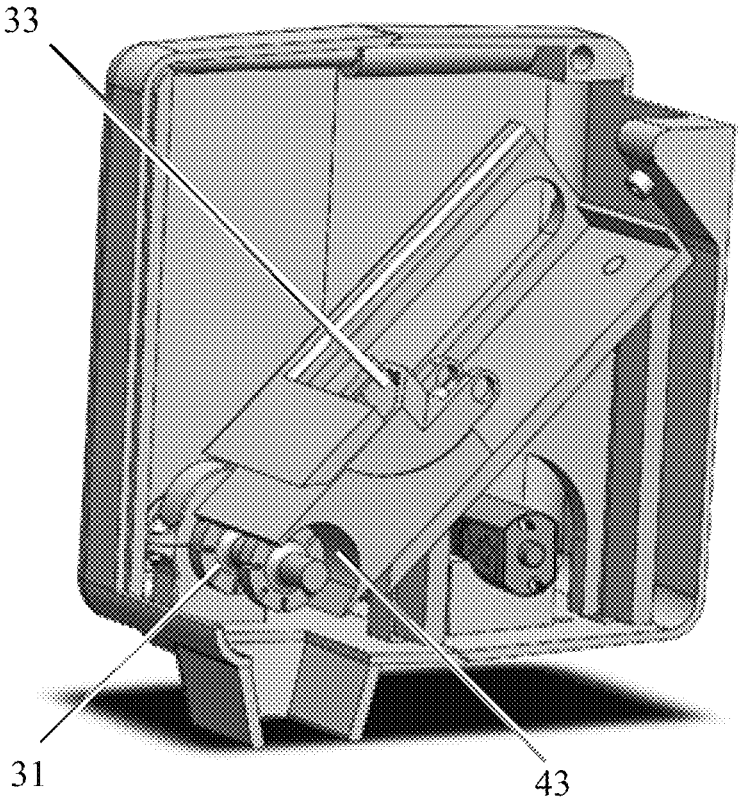
FIG. 32 shows a vertical cross-sectional view of the mechanism of FIG. 25.
Figure 33:
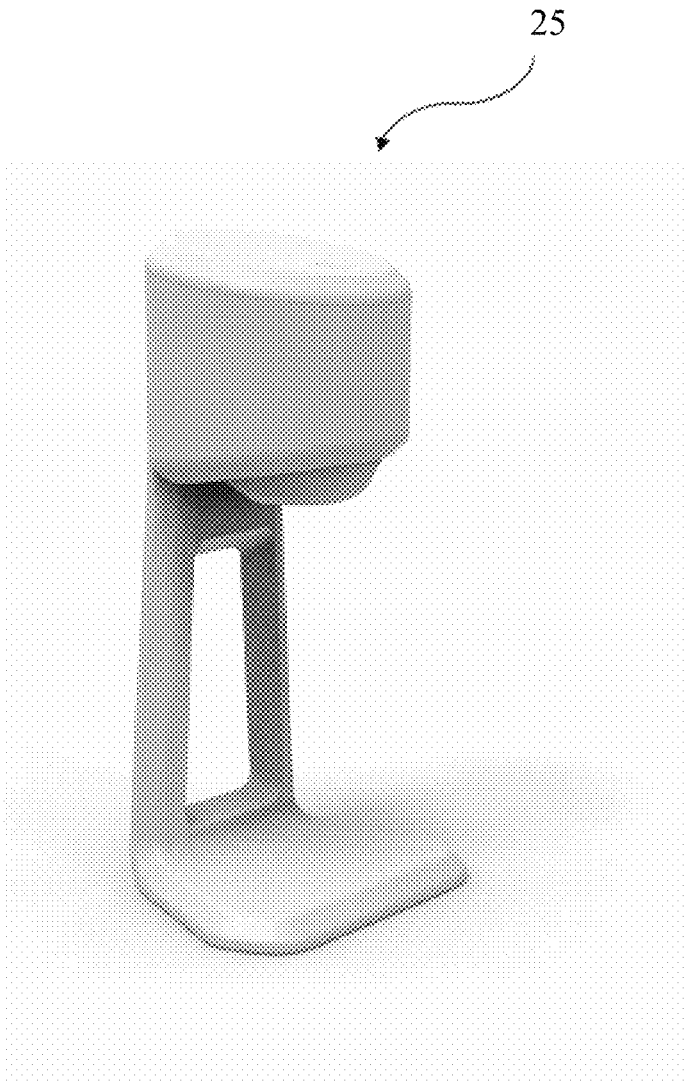
FIG. 33 shows a preferred embodiment of an external housing and stand used to hold the mechanism of FIG. 25.

FIGS. 25-32 show another preferred embodiment of a bar soap grinding dispenser mechanism 24 according to the invention which may be incorporated into housing and stand 25 of FIG. 33. The square-shaped housing 26 shown in FIGS. 25-32 may be contoured into a more pleasing design as shown in FIG. 33. This embodiment differs rom the embodiment shown in FIGS. 1-23 in that soap directional feeder 27 (FIG. 26) is positioned on an inclined plane with respect to bottom 28 of housing 26 which makes it easier to load a new bar of soap into mechanism 24.

Figure 27:
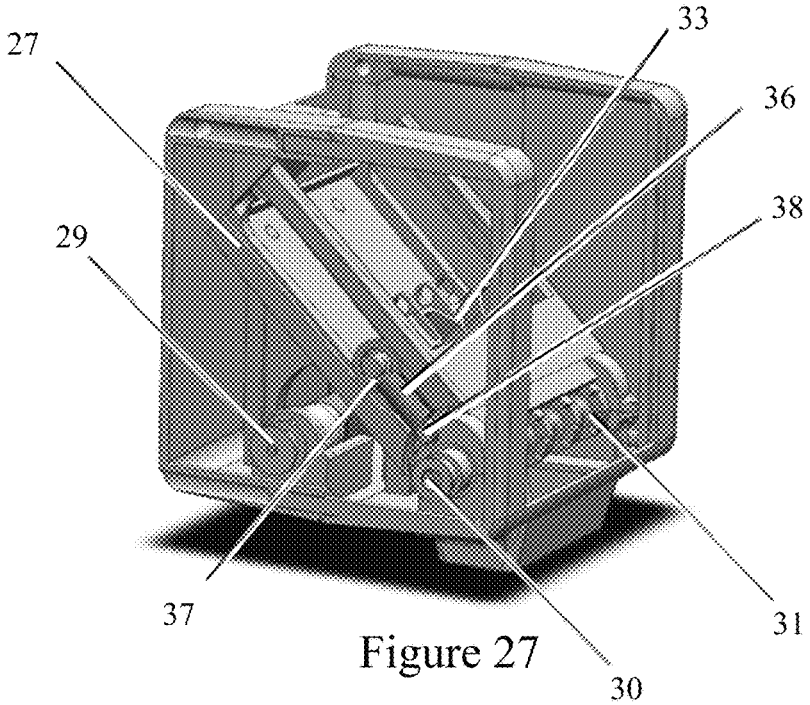
FIG. 27 is another view of the mechanism of FIG. 25 with its opposite sidewall and top removed to show internal components.

FIG. 27 shows motor 29 is positioned beneath soap directional feeder 27. A pulley-belt system connecting motor 29 to driven end 30 of rotary cutter 31 is not shown in order to make the details of the other parts of the mechanism more easily viewable. Various types of pulley-belt systems, such as pulley-belt system 11 shown in FIG. 22 may be used for example.

Figure 28:
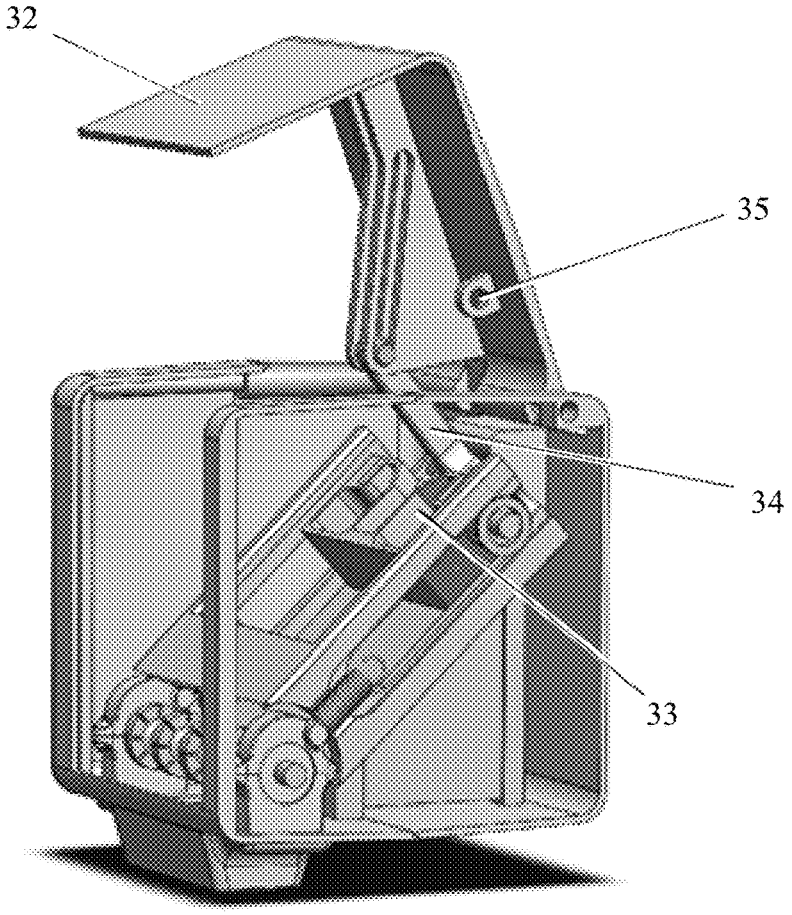
FIG. 28 shows the mechanism of FIG. 25 with its lid open.

FIG. 28 shows how lid 32 may be connected to pusher plate compression body 33 by a single, centrally located linkage arm 34. Another contemplated lid-connecting design involves dual linkage arms spaced apart within the lid. Opening 35 receives a pin (not shown) which connects one linkage arm (not shown) to one side of pusher plate compression body 33 while a second is connected to the other side. A further contemplated lid-connecting design involves cables taking the place of the linkage arms to reduce complexity and cost of manufacture. Lid 32, pusher plate compression body 33 and linkage arm 34 are spring-loaded by way of extension spring 36 which is shown in FIG. 27 attached at end 37 to pusher plate compression body 33 and to stationary rotor bearing mount 38. A second extension spring is positioned on the opposite side of the feeder 27, providing balanced spring-loading.

Figure 29:
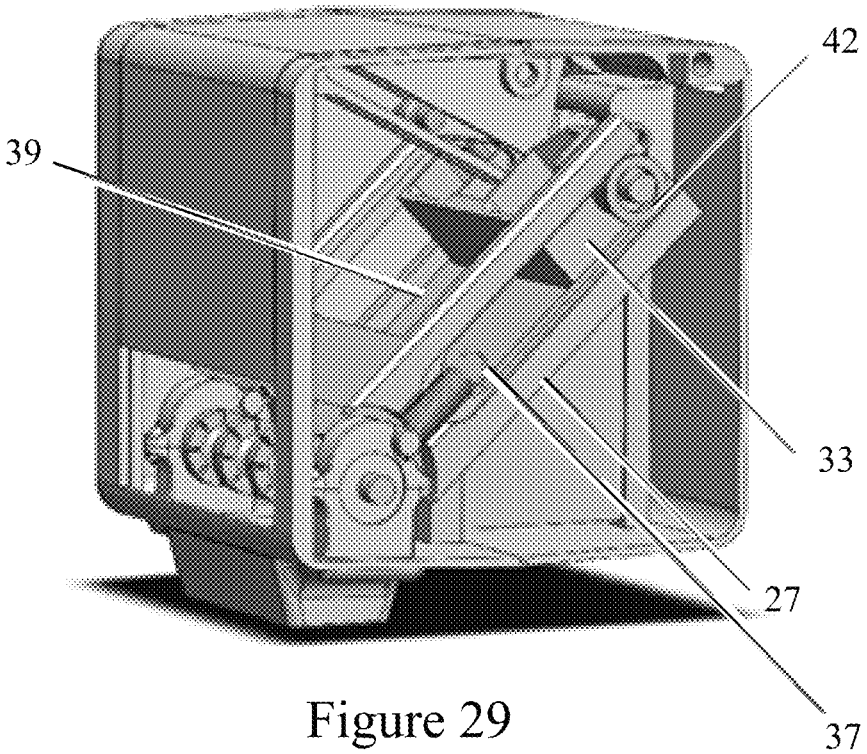
FIG. 29 shows the mechanism of FIG. 25 with its pusher plate in a retracted position.
Figure 30:
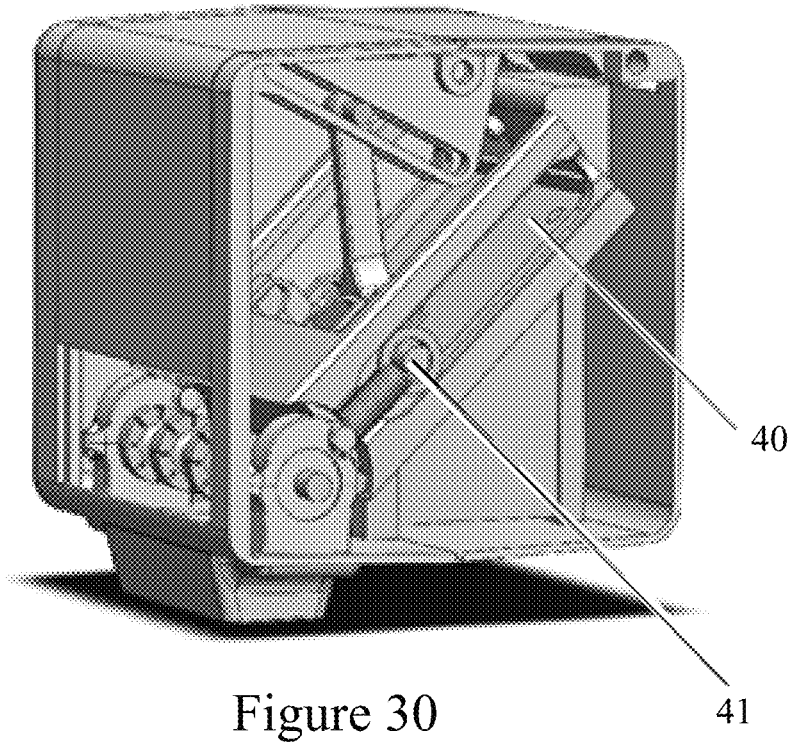
FIG. 30 shows the mechanism of FIG. 25 with its pusher plate in an extended position.

FIG. 29 illustrates pusher plate compression body 33 at its initial position within soap directional feeder 27 where a bar of soap (not shown) may be loaded at spot 39, while FIG. 30 illustrates the ending point of movement of pusher plate compression body 33 when a bar of soap has been ground and a new bar of soap is needed to be loaded into mechanism 24. (End 37 of extension spring 36 is shown as not being connected to pusher plate compression body 33 so that the details of soap directional feeder 27 may be more easily viewed. In application, spring 36 will be extended along the side of feeder 27 and be connected to compression body 33 as shown in FIG. 27.) These figures show how pusher plate compression body 33 is guided along feeder 27 by a pair of slotted openings 40 which receive body arms 41. Self-lubricating PTFE bushings 42 control sliding action of pusher plate compression body 33 along slotted openings 40.

FIGS. 31 and 32 show details of pusher plate compression body 33. FIG. 32 shows how concave face 43 of body 33 interacts with rotary cutter 31. There is clearance of approximately 1 millimeter between concave face 43 and rotary cutter 31 at body 33's lowest point of travel.

While the invention has been described in connection with a preferred embodiment, it is not intended to limit the scope of invention to the particular form(s) set forth, but on the contrary, it is intended to cover such alternatives, modifications, and equivalents as may be included within the spirit and scope of the invention as defined by patent claims. For example, a liquid crystal display (LCD) may be incorporated into the device's design which may be programmed to display information relating to the device's operation and/or to advertise the soap being dispensed.

Figure 34:
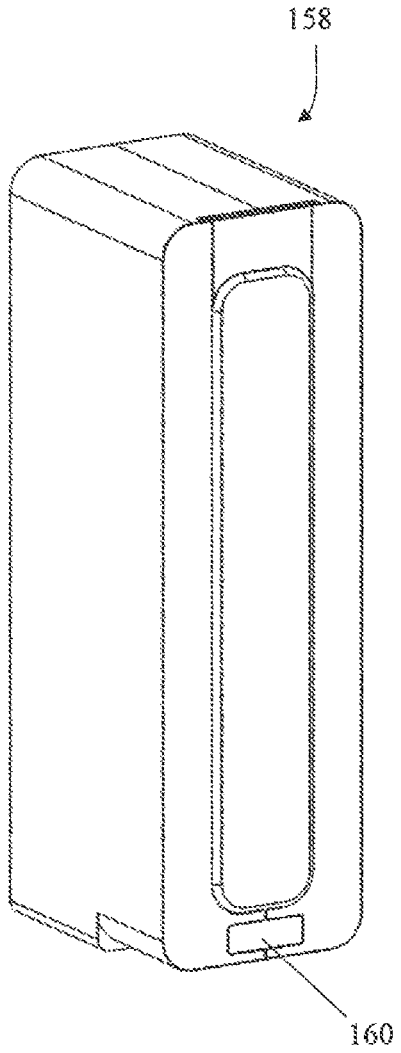
FIG. 34 is a front perspective view of an alternative embodiment of a soap grater and dispenser according to the invention.
Figure 35:
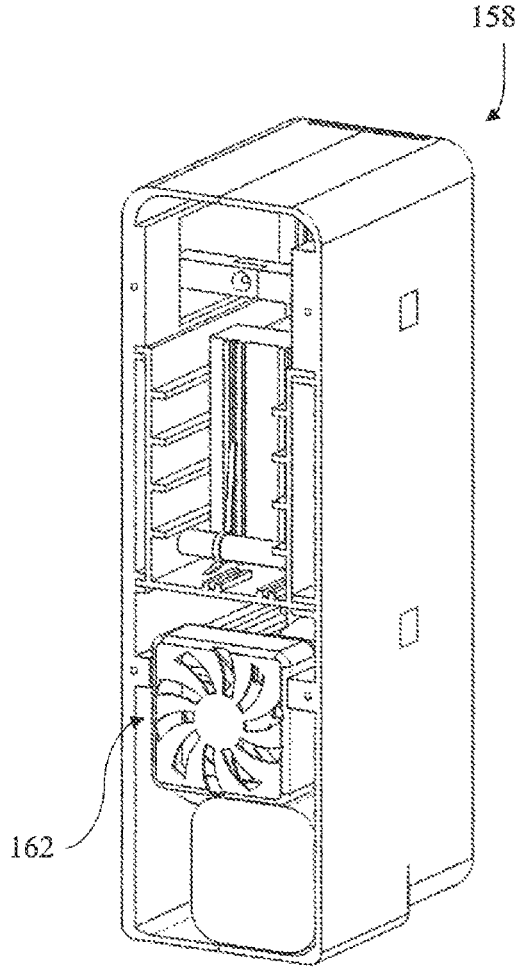
FIG. 35 is a rear perspective view of the alternative embodiment of the soap grater and dispenser of FIG. 34 with a rear panel removed to show otherwise hidden structure.

In this last regard, the reader is directed to FIGS. 33 and 34. FIGS. 33 and 34 show an alternative embodiment of a soap grater and dispenser 158 according to the invention that incorporates a liquid crystal display (LCD) as at 160 and an exhaust fan as at 162. LCD 160 is wired in circuit with the operation circuit and may be programmed to display information relating to the operation of grater/dispenser 158, such as number of times soap has been dispensed since last reset.

Integration of larger, more capable displays are also contemplated, such as color displays advertising the soap being dispensed or other paid advertising that may be changed and/or updated through wireless connectivity. In these situations, the LCD 160 would not necessarily be wired in with the operation circuit. Exhaust fan 162 is also connected in circuit with the operation circuit and is preferably programed to turn on for a period of time when the proximity detection sensor actuates the operation circuit, such that fragrance from the soap is exhausted through the dispenser opening in the housing when pieces of soap are dispensed.

What is claimed is:

1. A congealed product grinding and dispensing machine, comprising:

a housing having a first aperture through a first wall thereof;

an electric motor mounted within said housing and having a rotatable driveshaft, the rotatable driveshaft having a driveshaft axis of rotation;

a product chute assembly oriented perpendicularly to said driveshaft axis of rotation and mounted within said housing, over said first aperture, the product chute assembly comprising a feeder plate and a spring;

a rotatable grinder shaft mounted within said product chute assembly, the rotatable grinder shaft comprising a grinder shaft axis of rotation, an inner shaft portion, an outer shaft portion, and a cutting teeth portion, the inner shaft portion having a first shaft diameter, the outer shaft portion having a second shaft diameter, the second shaft diameter being greater than the first shaft diameter;

the cutting teeth portion comprising a radially inner basal portion and a plurality of circumferentially spaced cutting teeth, the plurality of circumferentially spaced cutting teeth extending radially outwardly from the radially inner basal portion;

the spring for applying pressure to the feeder plate, the feeder plate for pressing a congealed product toward the rotatable grinder shaft under pressure from the spring;

an actuator in circuit with said electric motor; and a control circuit in circuit with said actuator and said electric motor, that automatically energizes said electric motor for a preset time period when said actuator is actuated;

the plurality of circumferentially spaced cutting teeth removing chips from the congealed product, the product chute assembly directing the chips in free fall to a user, the user accessing the chips via the first aperture.

2. The congealed product grinding and dispensing machine of claim 1, wherein said actuator is a proximity sensor.

3. The congealed product grinding and dispensing machine of claim 1, further comprising:

a programmable display for displaying information relating to operation of the congealed product grinding and dispensing machine.

4. The congealed product grinding and dispensing machine of claim 3, wherein said programmable display is in circuit with said actuator.

5. The congealed product grinding and dispensing machine of claim 1, further comprising an electric fan mounted within said housing, adjacent said product chute assembly, and in circuit with said actuator, said electric fan positioned to blow air toward said product chute assembly and out said first aperture for enhancing directed chip movement.

6. A congealed product grinding and dispensing machine, comprising:

a housing having a first aperture through a first wall thereof;

a congealed product chute assembly oriented at an incline from said first wall of said housing and having an end proximate said first aperture of said housing;

an electric motor mounted within said housing and having a rotatable driveshaft;

a rotatable grinder shaft mounted adjacent said end of said congealed product chute assembly and adjacent said first aperture of said housing, the rotatable grinder shaft comprising an inner shaft portion, an outer shaft portion, and a cutting teeth portion, the inner shaft portion having a first shaft diameter, the outer shaft portion having a second shaft diameter, the second shaft diameter being greater than the first shaft diameter;

the cutting teeth portion comprising a radially inner basal portion and a plurality of circumferentially spaced cutting teeth, the plurality of circumferentially spaced cutting teeth extending radially outwardly from the radially inner basal portion;

a feeder plate movable within said congealed product chute assembly and spring-biased toward said rotatable grinder shaft, the feeder plate for pressing a congealed product toward the rotatable grinder shaft;

an actuator in circuit with said electric motor; and a control circuit in circuit with said actuator and said electric motor, that automatically energizes said electric motor for a preset time period when said actuator is actuated;

the plurality of circumferentially spaced cutting teeth removing chips from the congealed product, the congealed product chute assembly directing the chips in free fall to a user, the user accessing the chips via the first aperture.

7. The congealed product grinding and dispensing machine of claim 6, wherein said actuator is a proximity sensor.

8. The congealed product grinding and dispensing machine of claim 6, further comprising a programmable display for displaying information relating to operation of the congealed product grinding and dispensing machine.

9. The congealed product grinding and dispensing machine of claim 8, wherein said programmable display is in circuit with said actuator.

10. The congealed product grinding and dispensing machine of claim 6, further comprising an electric fan mounted within said housing, adjacent said congealed product chute assembly, and in circuit with said actuator, said electric fan positioned to blow air toward said congealed product chute assembly and out said first aperture.

11. The congealed product grinding and dispensing machine of claim 1 wherein the plurality of cutting teeth are obliquely angled relative to the grinder shaft axis of rotation.

12. The congealed product grinding and dispensing machine of claim 1 wherein the radially inner basal portion comprises a third shaft diameter, the third shaft diameter being equal to the second shaft diameter.

13. The congealed product grinding and dispensing machine of claim 1 wherein the radially inner basal portion comprises a third shaft diameter, the third shaft diameter being greater than the second shaft diameter.

14. The congealed product grinding and dispensing machine of claim 13 wherein a difference between the third shaft diameter and the second shaft diameter forms chip-directing channels, the chip-directing channels for directing free fall movement of chips cut from the congealed product.

15. The congealed product grinding and dispensing machine of claim 6 wherein the plurality of circumferentially spaced cutting teeth are obliquely angled relative to a grinder shaft axis of rotation.

16. The congealed product grinding and dispensing machine of claim 6 wherein the radially inner basal portion comprises a third shaft diameter, the third shaft diameter being equal to the second shaft diameter.

17. The congealed product grinding and dispensing machine of claim 6 wherein the radially inner basal portion comprises a third shaft diameter, the third shaft diameter being greater than the second shaft diameter.

18. The congealed product grinding and dispensing machine of claim 17 wherein a difference between the third shaft diameter and the second shaft diameter forms chip-directing channels, the chip-directing channels for directing free fall movement of chips cut from the congealed product.

* * * * *